US010553995B2

(12) United States Patent
Houry et al.

(10) Patent No.: US 10,553,995 B2
(45) Date of Patent: Feb. 4, 2020

(54) SNAP-LOCK RELAY SOCKET

(71) Applicant: Connecteurs Electriques Deutsch, Evreux (FR)

(72) Inventors: Laurent Houry, Le Roncenay-Authenay (FR); Martin Brunet, Evreux (FR)

(73) Assignee: Connecteurs Electriques Deutsch, Evreux (FR)

( * ) Notice: Subject to any disclaimer, the term of this patent is extended or adjusted under 35 U.S.C. 154(b) by 0 days.

(21) Appl. No.: 15/995,595

(22) Filed: Jun. 1, 2018

(65) Prior Publication Data

US 2018/0287311 A1 Oct. 4, 2018

Related U.S. Application Data

(63) Continuation of application No. PCT/EP2016/079273, filed on Nov. 30, 2016.

(30) Foreign Application Priority Data

Dec. 1, 2015 (EP) ..... 15306908

(51) Int. Cl.

| | |
|---|---|
| ***H01R 13/74*** | (2006.01) |
| ***H01H 50/04*** | (2006.01) |
| ***H01R 13/621*** | (2006.01) |
| *H01R 13/533* | (2006.01) |

(52) U.S. Cl.

CPC ..... *H01R 13/743* (2013.01); *H01H 50/048* (2013.01); *H01R 13/621* (2013.01); *H01R 13/533* (2013.01)

(58) Field of Classification Search

CPC ..... H01R 13/743; H01R 13/741; H01H 2050/046; H01H 50/047; H01H 50/021

USPC ..... 439/549, 552, 555, 557

See application file for complete search history.

(56) References Cited

U.S. PATENT DOCUMENTS

| | | | | |
|---|---|---|---|---|
| 2,757,353 A * | 7/1956 | Opalenik | ..... | H02B 1/04 439/552 |
| 4,453,195 A | 6/1984 | Sauer et al. | | |
| 5,482,476 A * | 1/1996 | Watanabe | ..... | H01R 13/743 439/555 |

(Continued)

FOREIGN PATENT DOCUMENTS

| | | |
|---|---|---|
| EP | 0572012 A1 | 12/1993 |
| GB | 2310550 A | 8/1997 |
| GB | 2462524 A | 2/2010 |

OTHER PUBLICATIONS

PCT Notification of Transmittal of the International Search Report and the Written Opinion of the International Searching Authority, dated Jan. 24, 2017, 13 pages.

*Primary Examiner* — Tulsidas C Patel
*Assistant Examiner* — Marcus E Harcum
(74) *Attorney, Agent, or Firm* — Barley Snyder

(57) ABSTRACT

A relay socket mountable on a mounting structure comprises a main body and a clipping system disposed on the main body. The main body has an upper part disposed on a first side of the mounting structure and a lower part extending beyond a fixation edge of the mounting structure to a second side of the mounting structure opposite the first side. The upper part of the main body receives a relay. The clipping system is adapted to lock the main body to the fixation edge.

20 Claims, 11 Drawing Sheets

(56) References Cited

U.S. PATENT DOCUMENTS

| | | | | |
|---|---|---|---|---|
| 5,658,167 | A * | 8/1997 | Shindoh | H01R 13/743 439/557 |
| 5,766,035 | A * | 6/1998 | Alibert | H01H 50/048 439/362 |
| 6,257,925 | B1 * | 7/2001 | Jones | H01R 13/6273 439/357 |
| 6,568,959 | B1 * | 5/2003 | Lo | H01R 9/035 439/544 |
| 6,752,642 | B2 * | 6/2004 | Ushiro | H01R 13/743 439/248 |
| 6,767,246 | B2 * | 7/2004 | Quinn | H01R 9/2491 439/555 |
| 7,338,317 | B1 * | 3/2008 | Nagy | H01R 13/745 439/555 |
| 7,488,905 | B2 * | 2/2009 | Kiely | H01R 13/745 174/650 |
| 7,708,589 | B2 * | 5/2010 | Shuey | H01R 13/745 439/552 |
| 8,529,291 | B2 * | 9/2013 | Kuhlmann | H01R 13/745 439/549 |
| 8,840,427 | B2 * | 9/2014 | Ku | H01R 13/745 439/552 |
| 2002/0142643 | A1 | 10/2002 | Quinn et al. | |
| 2009/0098768 | A1 | 4/2009 | Giefers | |

* cited by examiner

SNAP-LOCK RELAY SOCKET

CROSS-REFERENCE TO RELATED APPLICATIONS

This application is a continuation of PCT International Application No. PCT/EP2016/079273, filed on Nov. 30, 2016, which claims priority under 35 U.S.C. § 119 to European Patent Application No. 15306908.3, filed on Dec. 1, 2015.

FIELD OF THE INVENTION

The present invention relates to a socket for an electrical connector and, more particularly, to a relay socket that can be installed on an installation structure with a snap-lock mechanism.

BACKGROUND

Relay sockets for an electrical connector installed on an installation structure, such as a panel, are used for electrically connecting a large number of electrical relays side-by-side in a dense arrangement.

A conventional relay socket includes a base that is secured to the installation panel by, for example, bolts, screws, or nuts. Due to the number of small metallic parts to be aligned and tightened to the panel, the installation of this type of relay socket is time consuming and requires the use of specific tools, such as dynamometric equipment for verifying the fixations and metallic keys for tightening and removing the screws. Moreover, the access to the tightening elements with such tools is generally at a rear side of the panel, close to the wiring, and thereby risks damaging other cables during installation. The use of bolts or screws for fixing the socket also poses the problem that the screws become loose with time when subject to shocks and vibrations, such in aircraft applications, which requires time-consuming regular maintenance for verifying the state of all tightening elements.

Other types of relay sockets have been proposed to facilitate the installation of the socket on the panel.

A relay socket with a plurality of integral locking members for attaching and locking the relay socket to a structure surface, such as a panel, without the use of attachment hardware such as nuts or screws has been proposed in UK patent application GB 2462524 A. The locking members are stepped conical resilient members that pass through holes in the structure surface and then pass through holes in the relay, locking the relay socket to both the structure surface and the relay.

Another configuration of a panel-mounted connector for relays is described in UK patent application GB 2310550 A. The panel supports several relay bases into which relays can be plugged and includes elongated apertures with slots down each side. Each relay base is retained, on the rear side of the panel, by two resilient beams having outwardly-projecting catches that project through the apertures and overlap the front surface. Lugs on opposite sides of each base engage in the slots to prevent movement of the bases along the apertures. The relays are secured on the bases by screws that engage screw holes in the bases aligned with the slots. When mounted, a part of each relay lies between the catches, thereby preventing them from being displaced inwardly sufficiently to clear the edges of the aperture.

Although the above configurations reduce the number of screws required for installing the relay socket, an access to both front and rear sides of the installation panel is still required in order to mount and remove both the socket and the relay from the panel. Moreover, the panel must be provided with dedicated holes/slots for fixing the socket.

United States patent application publication US 2002/0142643 A1 describes a relay socket attachable to a cutout in a panel. The relay socket includes at least one rocker beam element at one side of the base and at least one active snap element at the opposite side of the base. The socket is inserted into place by engaging the rocker beam element on one side of a cutout in a panel and pivoting the active snap element toward the opposite side of the cutout so that it engages the opposite side of the cutout, moves inwardly, and is inserted into the cutout in the panel. When inserted into the cutout, the active snap element moves outwardly to engage the opposite side of the cutout and the elements cooperatively hold the socket onto the panel. Since the relay is plugged to the side of the base provided with the rocker beam element and the active snap element, this connection arrangement still requires access to both sides of the panel for mounting as well as for removing the relay and the base. Moreover, in order to remove the socket from the panel, access to both sides of the panel is necessary so as to press the snap element from one side while the base is simultaneously rotated from the other side of the panel for disengaging the rocker beam element.

SUMMARY

A relay socket mountable on a mounting structure comprises a main body and a clipping system disposed on the main body. The main body has an upper part disposed on a first side of the mounting structure and a lower part extending beyond a fixation edge of the mounting structure to a second side of the mounting structure opposite the first side. The upper part of the main body receives a relay. The clipping system is adapted to lock the main body to the fixation edge.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
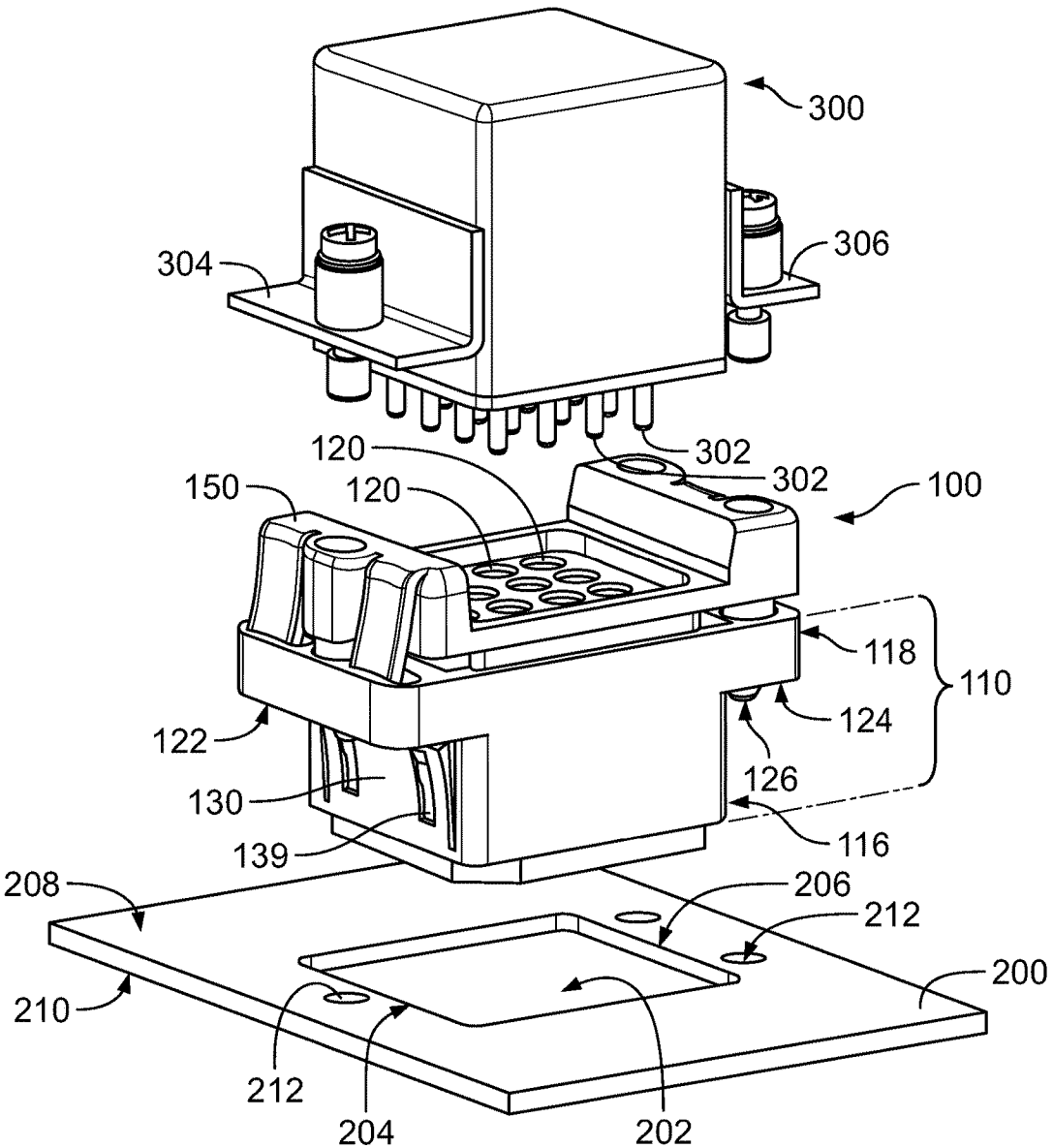
FIG. 1 is an exploded perspective view of a relay socket according to an embodiment of the invention with a mounting structure and a relay.

Exemplary embodiments of the present invention will be described hereinafter in detail with reference to the attached drawings, wherein like reference numerals refer to like elements. The present invention may, however, be embodied in many different forms and should not be construed as being limited to the embodiments set forth herein. Rather, these embodiments are provided so that the present disclosure will be thorough and complete and will fully convey the concept of the disclosure to those skilled in the art.

A relay socket 100 according to an embodiment of the invention is shown in FIG. 1 with a mounting structure 200 and a relay 300 to be plugged into the relay socket 100. In the shown embodiment, the relay 300 is a conventional relay.

The mounting structure 200 is a panel in the embodiment shown in FIG. 1. The mounting structure 200 has an aperture 202 for partially receiving the relay socket 100. In the shown embodiment, the mounting structure 200 is a square panel with the aperture 202 cut-out from the panel 200. The aperture 202 has a rectangular shape that substantially fits a lower side of the socket 100 and to which the socket 100 is fixed at two opposite fixation edges 204, 206 of the aperture 202. In other embodiments, the relay socket 100 is mounted on other types of mounting structures and/or apertures as long as two fixation edges are provided for attaching the socket 100 and between which the socket 100 can be partially inserted, such as between two parallel plates of an installation panel at a sufficient distance from each other for receiving and mounting the socket 100. The aperture 202 is thereby not limited to a panel cut-out and may have other shapes; the aperture, for example, may be an extended slot cut-out on a panel for installing a number of relay sockets 100 side-by-side.

The relay socket 100, as shown in FIG. 1, has a main body 110 adapted to be inserted from a first side 208 of the mounting structure 200. The first side 208 of the mounting structure 200 is a same side of the panel 200 from which the relay 300 is plugged into the socket 100. Hereinafter, the first side 208 will be referred to as the front side 208 and a second side 210 opposite the front side 208 will be referred to as the rear side 210.

Figure 2:
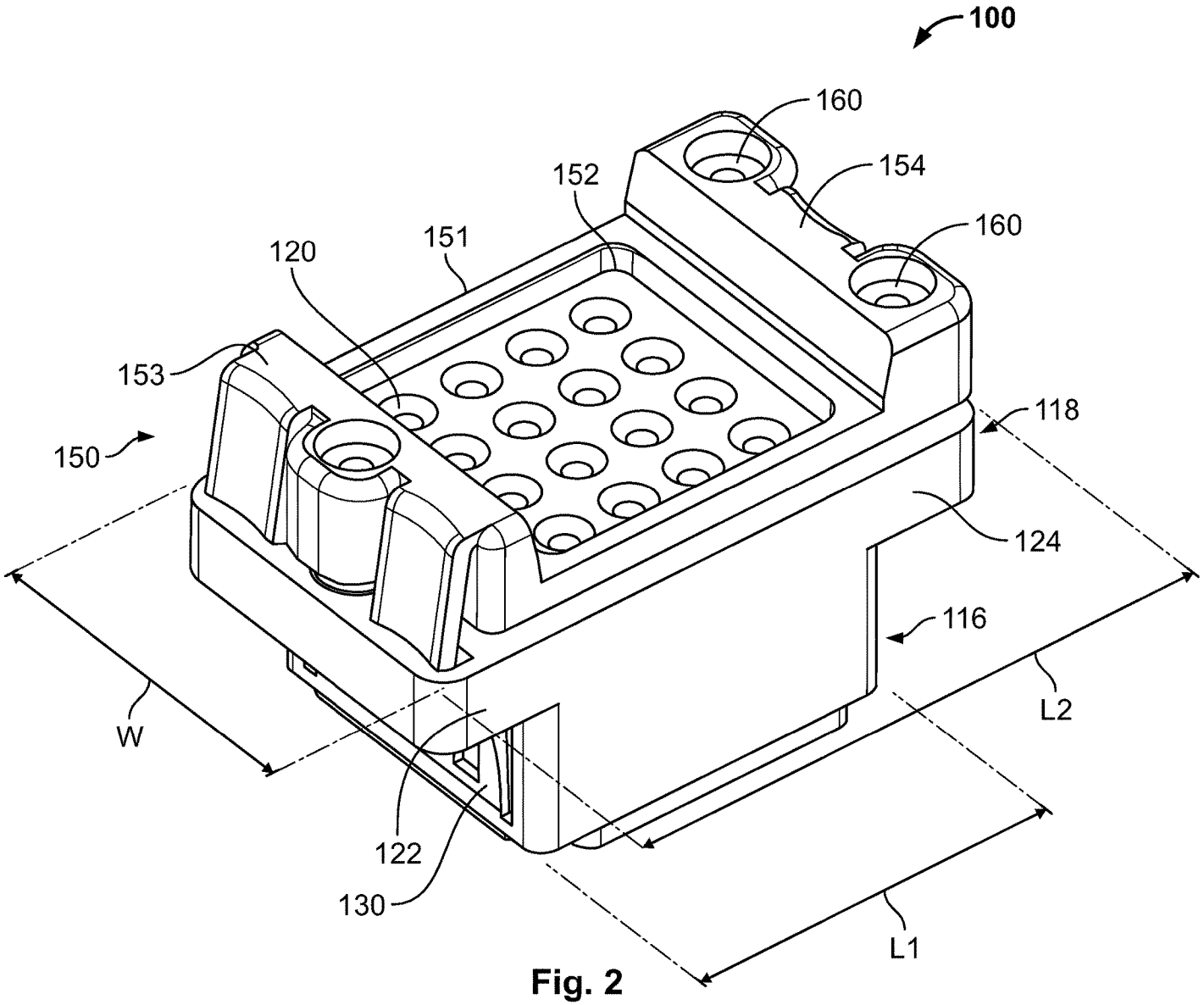
FIG. 2 is a perspective view of the relay socket in an opened configuration with an actuation member of the relay socket in a neutral position.

The main body 110, as shown in FIG. 1, has an external shape such that a lower part 116 of the main body 110 has a cross-section capable of passing through the aperture 202 to the rear side 210 of the panel 200. In the shown embodiment, the lower part 116 has a substantially rectangular shape with a longitudinal length L1 and a width W, as shown in FIG. 2, that are approximately equal to the dimensions of the aperture 202 so as to provide a good fit of the socket 100 in the aperture 202, but are slightly lower than the dimensions of the aperture 202 so that the lower part 116 can be inserted through the aperture 202. The length L1 and width W are also approximately equal to a separation between the fixation edges 204, 206 and to a length of the fixation edges 204, 206, respectively. The width W of the lower part 116 is not a critical parameter for the purpose of securing the socket 100 to the mounting structure 200; in other embodiments, the length of the fixation edges 204, 206 may be larger than W.

An upper part 118 of the main body 110, shown in FIG. 1, has a larger cross-section along a plane parallel to the mounting structure 200 than the lower part 116 so as to block a further insertion of the socket 100 through the aperture 202 and to remain arranged on the front side 208 for plugging the relay 300. The upper part 118 has two ledges 122 and 124 that extend outwards beyond the longitudinal length L1 of the lower part 116, over a total longitudinal length L2 as shown in FIG. 2, so that the upper part 118 physically contacts the mounting structure 200 when the socket 100 is inserted through the aperture 202 and blocks a further displacement of the socket 100 through the aperture 202. In an embodiment, the width W of the upper part 118 is the same as that of the lower part 116 for providing a socket 100 with a more compact design.

In an embodiment, the main body 110 is made of molded electrically insulating materials, such as plastic materials. In the embodiment shown in FIG. 1, the main body 110 is formed as a single block, with the upper and lower parts 118 and 116 monolithically formed of the same block material.

As shown in FIG. 1, the upper part 118 has a number of openings 120 arranged in a central area for plugging the contact pins 302 provided on a lower side of the relay 300. The openings 120 are electrically coupled to corresponding openings on the opposite side of the main body 110 via connecting elements known in the art that are provided inside the main body 110. The positioning and alignment of the main body 110 on the mounting structure 200 is facilitated by providing one or more guiding pins 126 on the side of the ledges 122, 124 that faces the mounting structure 200 for fitting into respective guiding holes 212 provided on the mounting structure 200.

In order to fix the relay socket 100 to the panel 200, the relay socket 100 has an integrated clipping system 130 for locking the socket 100 to the fixation edges 204, 206 when the socket 100 is in place without the use of any tightening elements or tools. The integrated clipping system 130 is disposed on the main body 110 and is mechanically coupled to an actuation member 150 provided over the upper part 118 of the main body 110. A locking state of the clipping system 130 can be set or changed by operating the actuation member 150. As is described in greater detail below, the actuation member 150 can be moved downwards and/or upwards with respect to the main body 110 among a neutral position (opened configuration) and at least one of a locking position (closed configuration) and an unlocking position (removal configuration).

Figure 3:
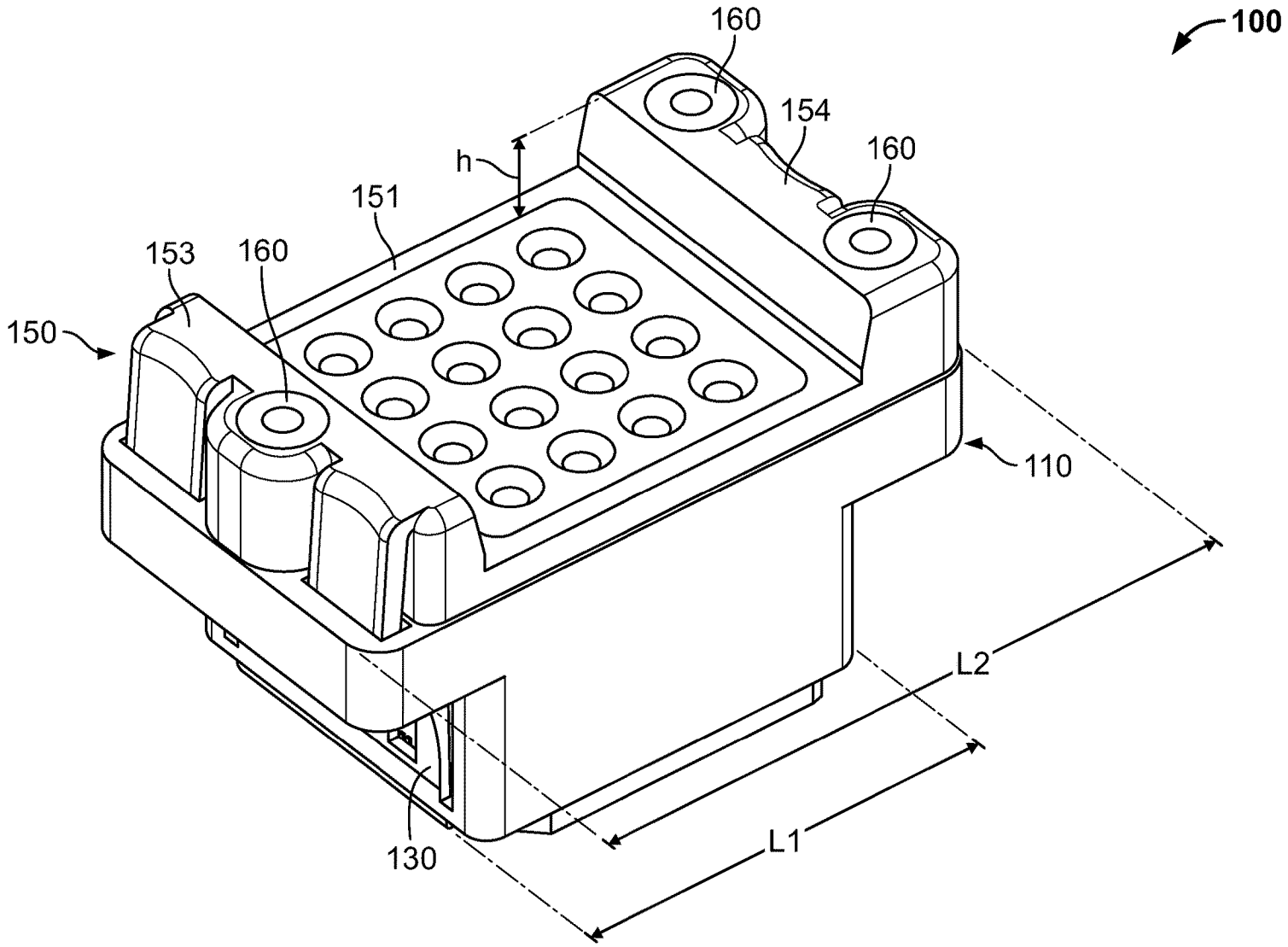
FIG. 3 is a perspective view of the relay socket in a closed configuration with the actuation member in a locking position.
Figure 4:
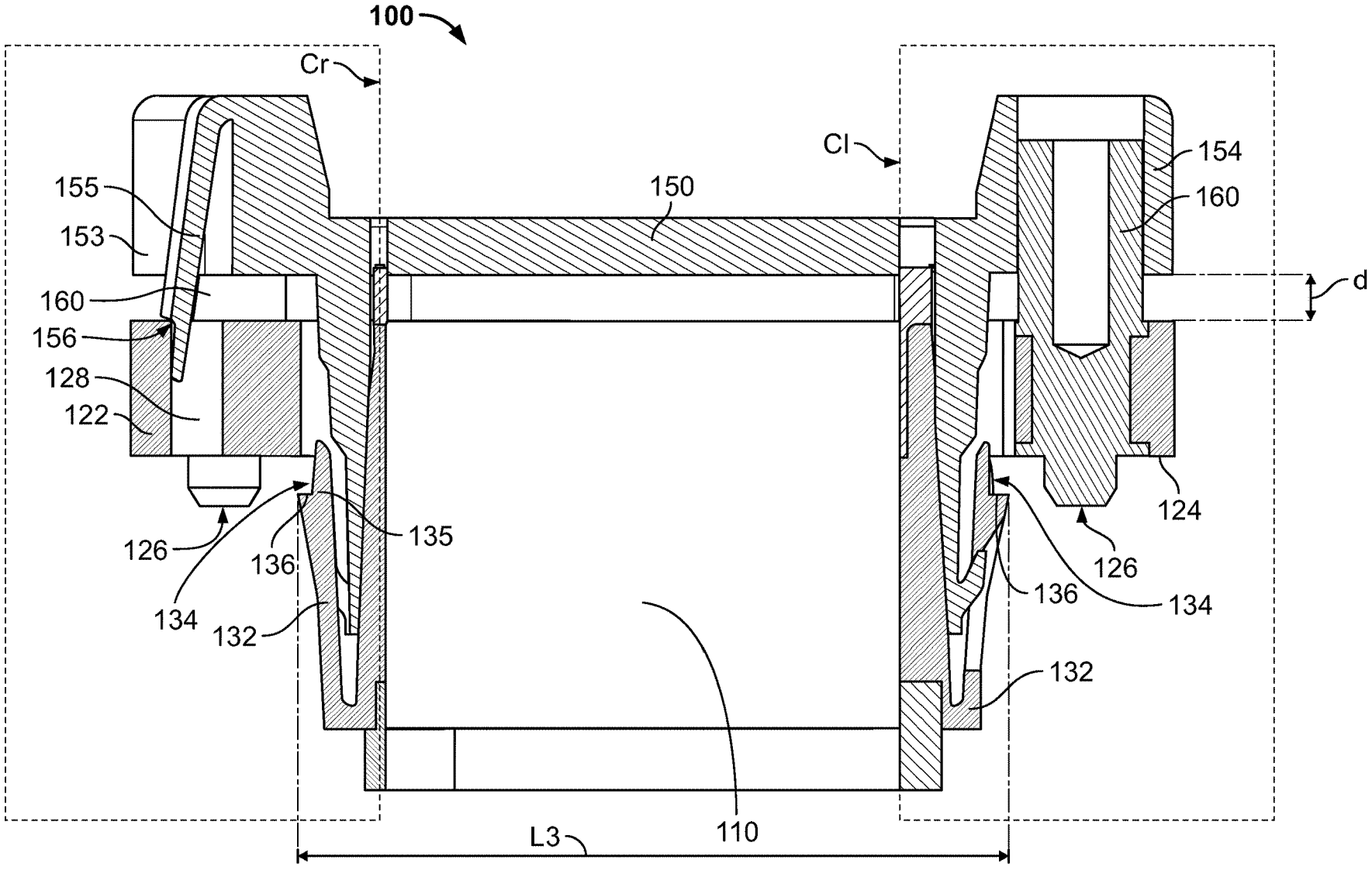
FIG. 4 is a sectional side view of the relay socket in the opened configuration and the actuation member in the neutral state.
Figure 10:
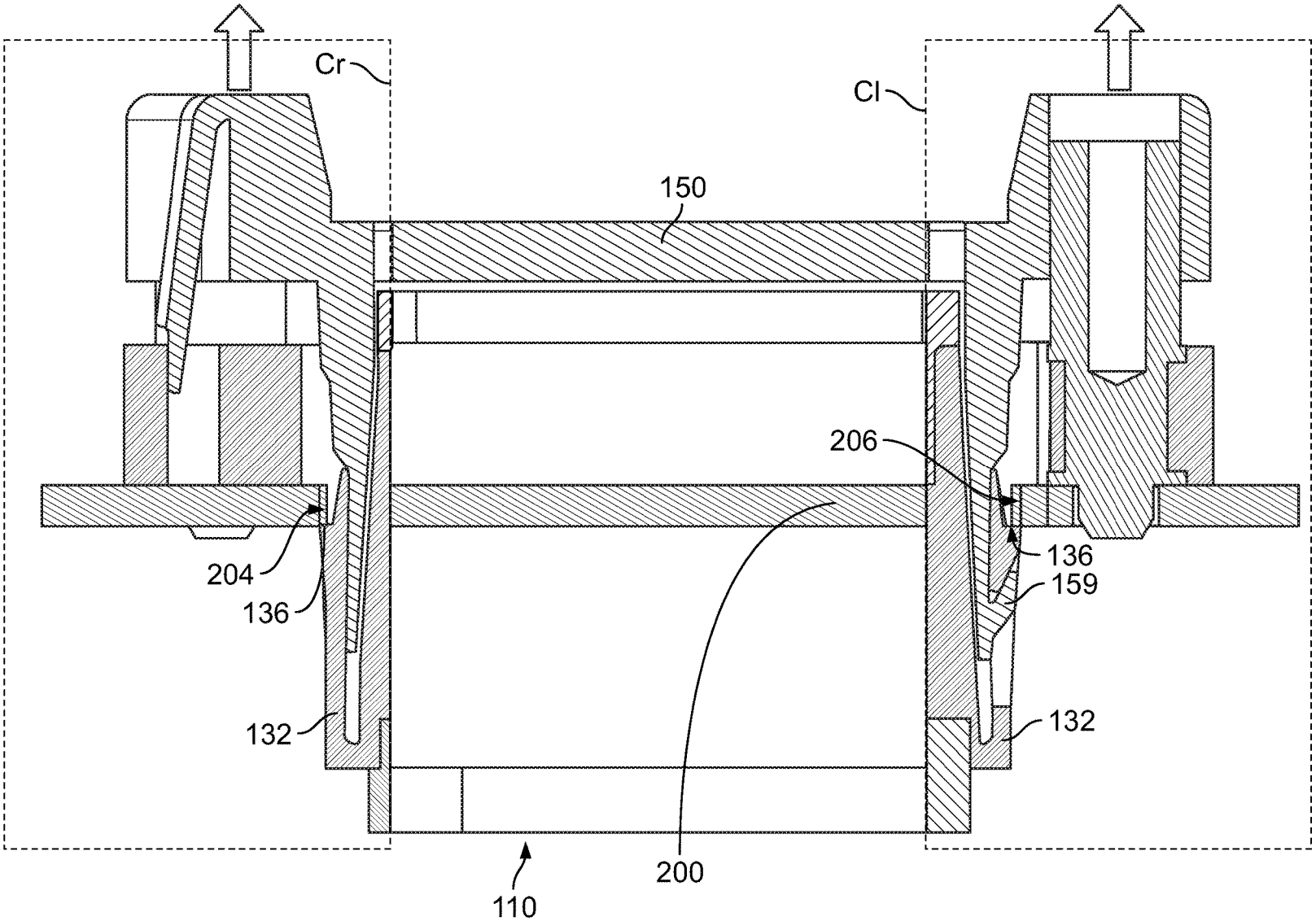
FIG. 10 is a sectional side view of the relay socket in a removal configuration with the actuation member in an unlocking position.
Figure 11:
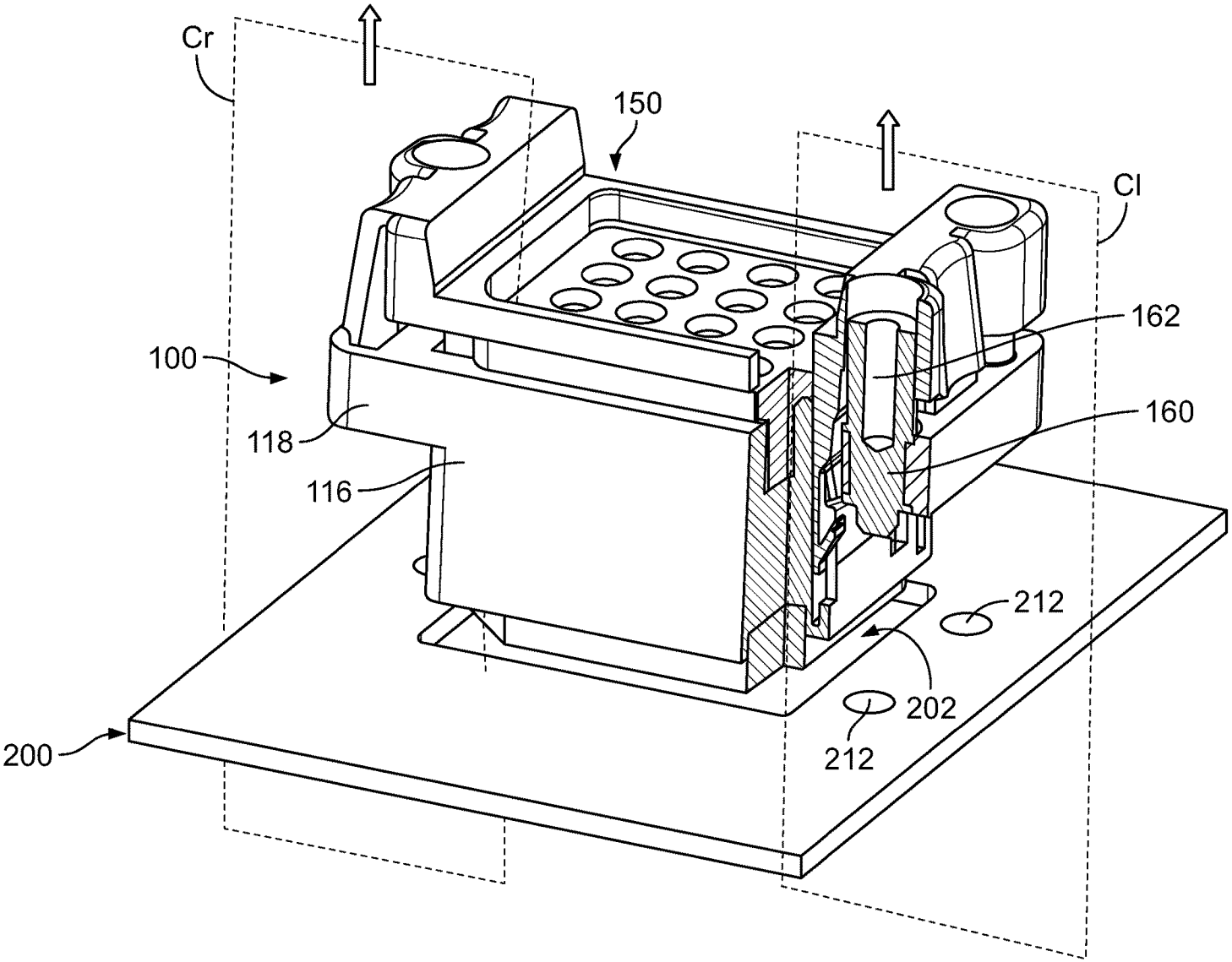
FIG. 11 is a sectional perspective view of the relay socket removed from the mounting structure with the actuation member at a highest position.

The relay socket 100 is shown in the opened configuration in FIG. 2, in which the actuation member 150 is positioned in the neutral position at a certain distance d shown in FIG. 4 above the upper part 118. In the neutral position, the clipping system 130 is not actuated by the actuation member 150 and the relay socket 100 can be freely inserted into the aperture 202. Once inserted into the aperture 202, the actuation member 150 is lowered to the locking position and actuates the clipping system 130 to lock the main body 110 to the fixation edges 204, 206. The closed configuration of the relay socket 100, corresponding to the locking position of the actuation member 150, is shown in FIG. 3, in which the actuation member 150 is completely lowered onto the upper part 118. In the unlocked position, by contrast, the actuation member 150 is in a higher position above the neutral position and actively disengages the clipping system 130 from the fixation edges 204, 206 for removing the relay socket 110 from the mounting structure 200. The removal configuration of the relay socket 100, with the actuation member 150 in the unlocking position, is shown in FIGS. 10 and 11. The relay socket 100 can be easily mounted and/or removed from the mounting structure 200 without the need of any screws or tools by simply actuating the actuation member 150 and does not require access to both the rear and front sides 210, 208 of the installation panel 200.

The actuation member 150 is designed so that the relay 300 can only be plugged into the socket 100 when the actuation member 150 is in the closed configuration. As shown in FIGS. 2 and 3, the actuation member 150 has a stirrup shape having a central, flat base 151 with an opening 152 for providing access to the plug openings 120 on the upper part 118, and two lateral supports 153, 154 at the left and right sides of the flat base 151 for arranging fixation plates 304, 306 of the relay 300 as shown in FIG. 1. A height h of the lateral supports 153, 154, shown in FIG. 3, is selected such that the relay pins 302 can be fully inserted into the openings 120 of the main body 110 only when the actuation member 150 is in its lowest position. The stirrup shape thus prevents the relay 300 from being plugged when the socket 100 is not in the closed configuration.

The relay socket 100, as shown in FIG. 4, includes one or more guiding columns 160 that extend vertically along through-holes provided on the supports 153, 154 of the actuation member 150 and of the main body 110. The guiding columns 160 guide the actuation member 150 in the upward and downward movement with respect to the main body 110 and are, therefore, only fixed to the ledges 122, 124 but not to the actuation member 150 itself. In the shown embodiment, an end part of the guiding columns 160 partially protrudes from the lower side of the ledges 122, 124 so as to serve as the guiding pins 126. The guiding columns 160 are formed from a material having a good wearing resistance against relative movement between parts and suitable for tightening a screw, such as a metal. The guiding columns 160 may also serve for fixing the relay 300 onto the relay socket 100 by screwing, as it will be described in greater detail below with reference to FIG. 8. Thus, the guiding columns 160 allow aligning the relay 300 in the right position with respect to the electrical contact openings 120 provided on the socket 100, as well as the assembly of the relay 300 and socket 100 with respect to the mounting structure 200.

The clipping system 130 includes one or more clipping members 132 for securing the main body 110 to the mounting structure 200. As shown in FIG. 4, the clipping system 130 includes two clipping members 132 that are respectively provided on lateral sides of the lower part 116, opposite to each other. The clipping members 132 are attached to the lower part 116 at a lower end and extend upwards along a lateral side of the main body 110 at a given separation distance. Each clipping member 132 is provided with an inward-projecting recess 134 at an upper end 135 for engaging with the respective fixation edges 204, 206 when the socket 100 is installed in the aperture 202. The inward-projecting recess 134 forms a shoulder 136 that will block the removal of the relay socket 100 from the aperture 202 when the clipping system 130 is in the locking state. The clipping members 132 have resilient properties so that they can be flexed towards the main body 110 under inward pressure, such as the pressure exerted by the fixation edges 204, 206 when the lower part 116 is inserted through the aperture 202, and to resiliently return towards the neutral state when such pressure is completely or partially released.

A process of assembling the relay socket 100 to the mounting structure 200 and the relay 300 will now be described with reference to FIGS. 4-8.

The relay socket 100 is shown in the opened configuration and the clipping members 132 are in a neutral state in FIG. 4. In the neutral state, the distance L3 between the shoulders 136 of the opposite clipping members 132 is larger than the longitudinal length L1 of the lower part 116 and larger than the distance La between the fixation edges 204, 206 shown in FIG. 5.

The actuation member 150 is stably maintained in the neutral position shown in FIG. 4 at a distance d above the upper part 118 by clipping legs 155 provided on the lateral supports 153, 154. The clipping legs 155 prevent a downward displacement of the actuation member 150 towards the main body 110. The clipping legs 155 are attached to the top side of the actuation member 150 and project downwards into respective openings 128 provided on the ledges 122, 124. On its outer side, the clipping leg 155 has an inward-projecting recess 156 at a lower end for forming a catch that engages with an edge of the opening 128 and blocks any downward movement of the actuation member 150 with respect to the main body 110, even when force is applied on the top side of the actuation member 150 to push the relay socket 100 into the aperture 202.

Figure 5:
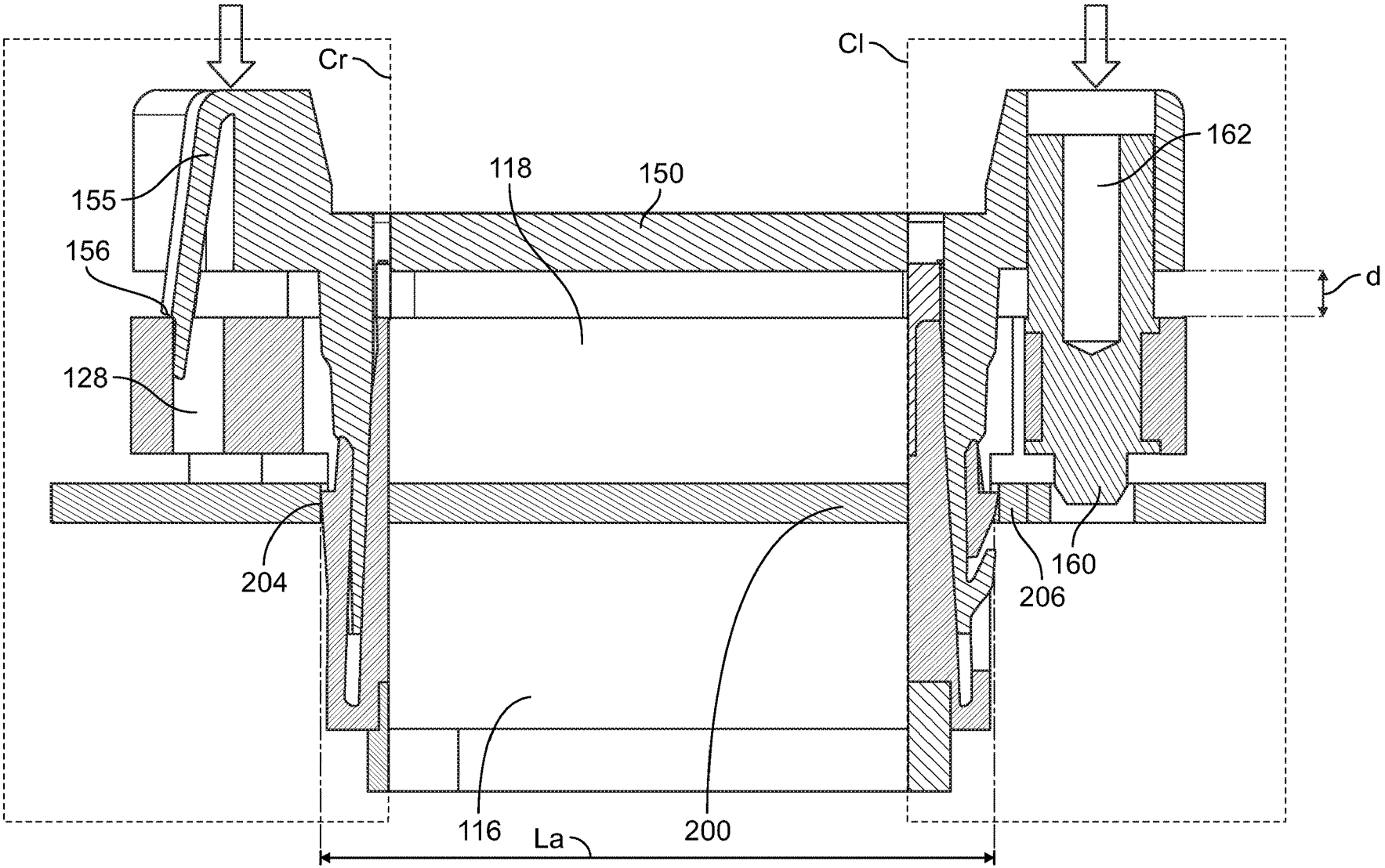
FIG. 5 is a sectional side view of the relay socket in the opened configuration and the actuation member in the neutral state in an initial stage of a process of mounting the relay socket in the mounting structure.
Figure 6:
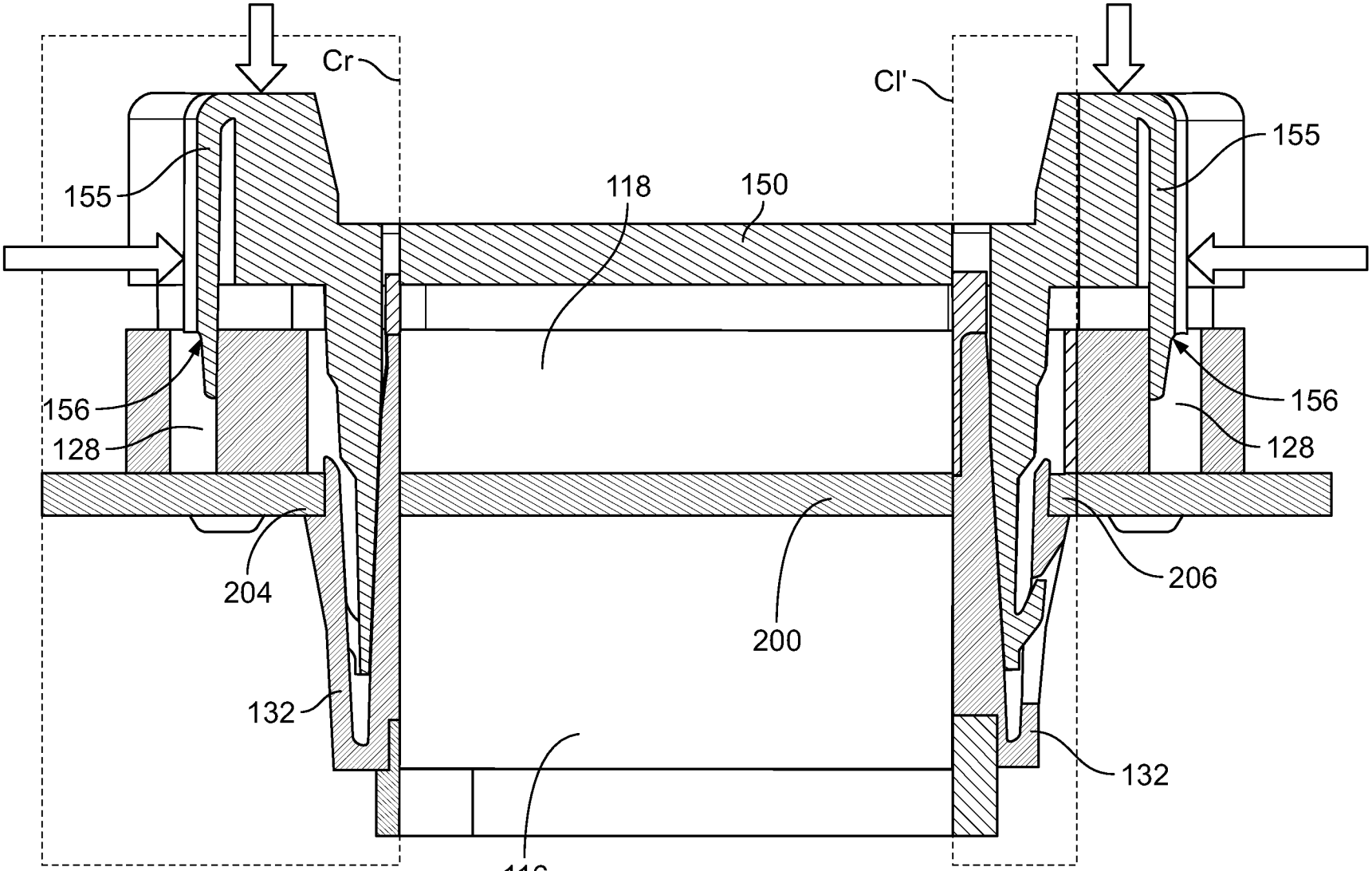
FIG. 6 is a sectional side view of the relay socket fully inserted into the mounting structure and the actuation member ready to be lowered from the opened configuration to the closed configuration.

As shown in FIG. 5, in the opened configuration the relay socket 100 can be easily inserted through the aperture 202 by applying force on the top of the actuation member 150 in the direction of the arrows, since the actuation member 150 is not actuating on the clipping system 130. The clipping members 132 are then freely flexed away from their neutral state by the inward force applied by the fixation edges 204, 206, shown in FIG. 5, and are released back when the socket 100 reaches the mounting position and the inward recesses 134 engage with the fixation edges 204, 206, as shown in FIG. 6. The thickness of the clipping member 132 may increase from its lower end to the shoulder 136 so that the force applied by the fixation edges 204, 206 is gradually increased during the insertion of the socket 100 to a maximum and is then suddenly decreased for facilitating the engagement of the recess 134 with the respective fixation edge 204, 206.

As shown in FIG. 6, once the socket 100 is inserted into the aperture 202 and the clipping members 132 are respectively engaged on the fixation edges 204 and 206, the relay socket 100 is pre-clipped into the panel 200. The actuation member 150 is then operated so as to be lowered from the opened configuration to the closed configuration. The clipping leg 155 has spring characteristics that allow the leg 155 to be easily flexed inwards towards the actuation member 150 by applying inward pressure, for instance, with the operator's fingers along the direction shown by the horizontal arrows in FIG. 6, so as to disengage the catch 156 of the clipping leg 155 from the upper edge of the opening 128. The clipping leg 155 can then be further inserted through the opening 128 and no longer blocks the actuation member 150, which may then be moved downwards towards the main body 110 until reaching the locking position in the closed configuration.

Figure 7:
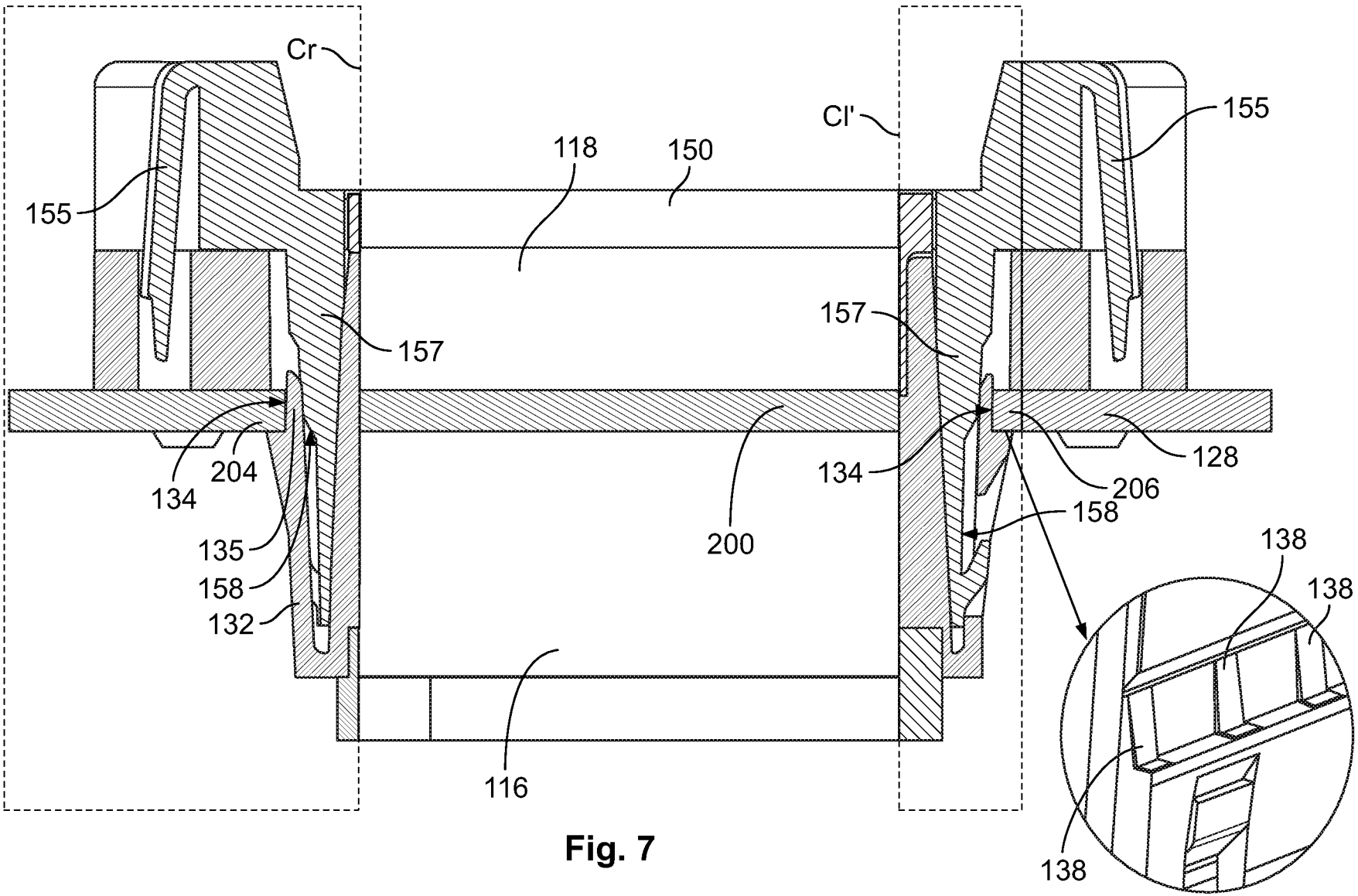
FIG. 7 is a sectional side view of the relay socket in the closed configuration and locked to the mounting structure.

As shown in FIG. 7, the actuation member 150 includes at least one interlocking element 157 which projects from a lower side of the actuation member 150 downwards and partially extends into a gap region between the clipping member 132 and the main body 110. The interlocking element 157 has a number of features that mechanically interact with features of the clipping member 132 so as to change the state of the clipping system 130 depending on the position of the actuation member 150.

The interlocking element 157, as shown in FIG. 7, has a profile with a recess 158 on the side facing the clipping member 132. The recess 158 forms an outward shoulder that is brought into contact with the end part of the clipping member 132, on the side opposed to the clipping member recess 134, when the actuation member 150 is pushed down into the closed configuration, forcing the clipping member recess 134 against the respective fixation edge 204 or 206 and locking the main body 110 into the mounting position. In order to improve the engagement of the clipping member recesses 134 against the fixation edges 204, 206, in an embodiment, the recesses 134 have one or more specific collapsible features 138 to offset the panel 200 cut-out limits. The collapsible features 138 have different shapes and are made from a deformable, thermoplastic material that can be deformed under the pressure exerted by the fixation edges 204, 206 against the recesses 134 so as to improve the fixation of the relay socket 100 against vibrations and shocks.

Figure 8:
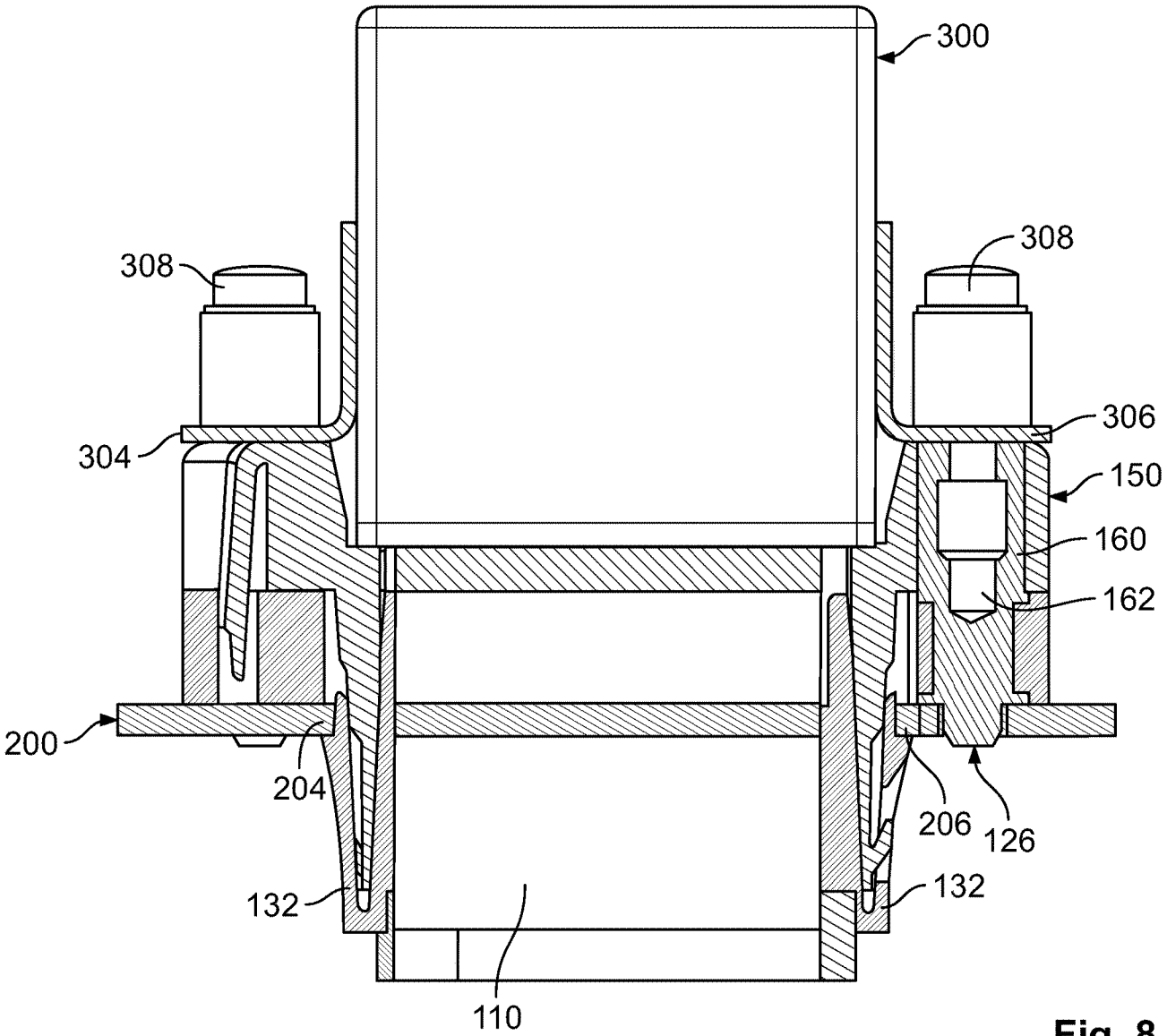
FIG. 8 is a sectional side view of the relay socket in the closed configuration and locked to the mounting structure and the relay plugged into the relay socket.

Once the relay socket 100 is mounted in the aperture 202 and locked into position in the closed configuration, the relay 300 can be plugged to the relay socket 100 and secured to the socket 100 as shown in FIG. 8. The guiding columns 160 of the relay socket 100 have vertical openings, such as blind holes 162 for receiving a tightening element, such as a screw 308. The guiding columns 160 are aligned with tightening elements 308 of the relay 300 for securing the relay 300 to the socket 100. In an embodiment, each blind hole 162 has a threaded region for tightening the screw 308. The threaded region is provided at a predetermined depth such that the screw 308 can only be screwed when the relay socket 100 is in the closed configuration, preventing the relay 300 from being fixed to the socket 100 when the clipping system 130 is not in the locking state, and therefore, the relay socket 100 is not securely fixed to the mounting structure 200. The fixation of the relay 300 by tightening the screws 308 to the socket 100 simultaneously secures the actuation member 150 against the main body 110 in the closed configuration so that the relay socket 100 cannot be accidentally demounted without first removing the relay 300.

A process and features for removing the relay socket 100 from the mounting structure 200 will now be described with reference to FIGS. 9-11.

Figure 9:
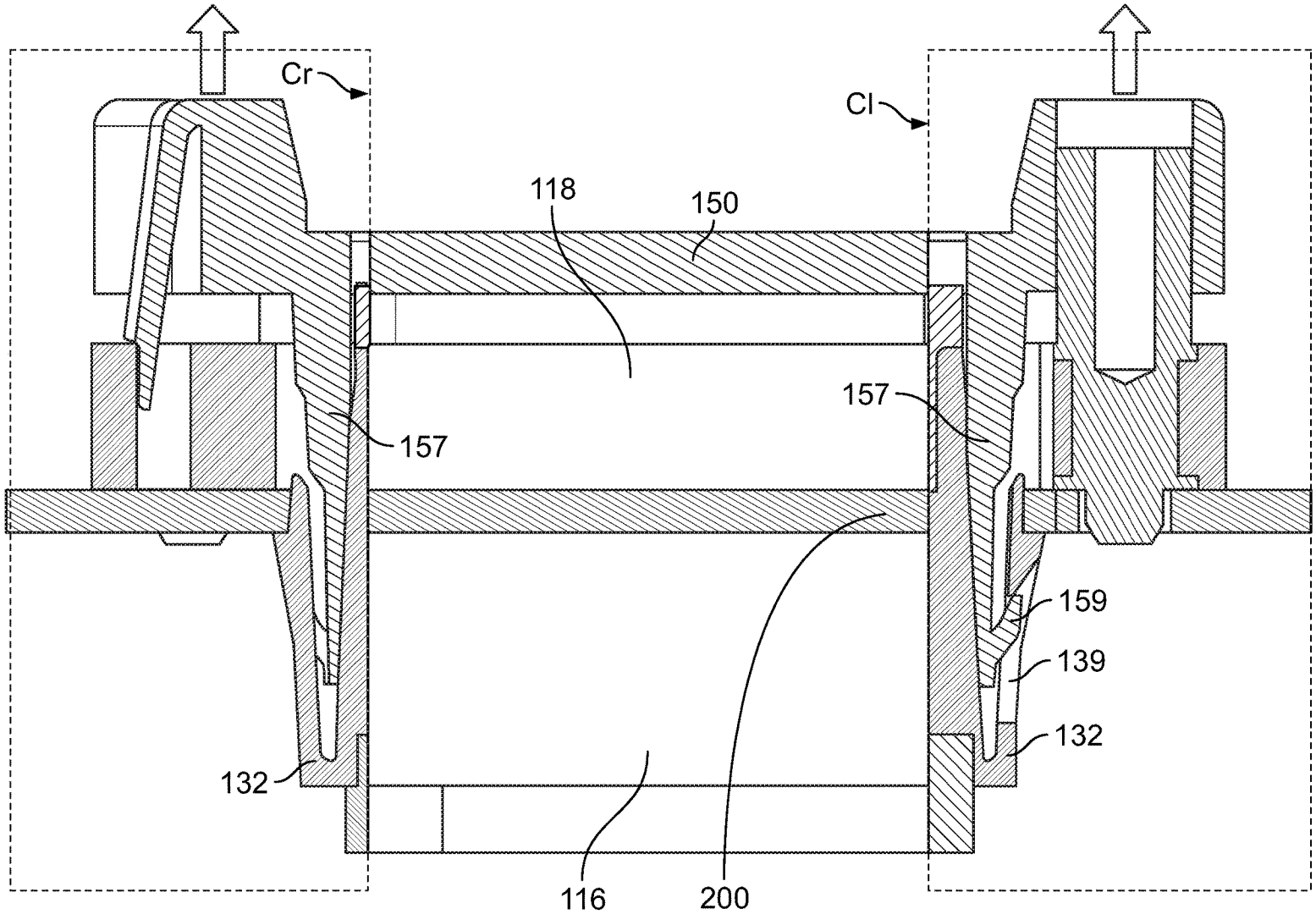
FIG. 9 is a sectional side view of the relay socket in the opened configuration in a process of removing the relay socket from the mounting structure.

A stage of a process of removing the relay socket 100 from the mounting structure 200 is shown in FIG. 9, in which the relay socket 100 is returned back to the opened configuration automatically by pulling the actuation member 150 in the direction indicated by the arrows into the neutral position. The interlocking elements 157 of the actuation member 150 do not actuate on the clipping members 132 to put them into the rest position; the elasticity of the clipping members 132 is sufficient for returning them towards to the neutral state. An upward displacement of the main body 110 of the relay socket 100, however, is still blocked by the mounting structure 200 in the stage shown in FIG. 9.

In order to unclip the relay socket 100 from the panel 200, the actuation member 150 is further pulled in the upward direction, as shown in FIG. 10, so as to actively un-lock the relay socket 100 from the mounting structure 200. As shown in FIGS. 9 and 10, the interlocking element 157 includes an outward-projecting barb 159 at a lower end that can move along a respective vertical slot 139 provided on the clipping member 132 when the actuation member 150 is moved between the opened and the closed configurations. The vertical slot 139 has an upper edge with an inclined profile that matches the barb 159 so that the barb 159 progressively engages with the clipping member 132 when the actuation member 150 is moved from the opened configuration, shown in FIG. 9, to the unlocking position in the removal configuration, shown in FIG. 10, and flexes the clipping member 132 towards the main body 110, disengaging the clipping member 132 from the aperture edges 204, 206. The full engagement with the clipping member 132 is attained in the unlocked state shown in FIG. 10, in which the barb 159 is fully engaged with the clipping member 132 and pushes the clipping member 132 towards the main body 110, completely disengaging the clipping member shoulder 136 from the fixation edges 204, 206. The relay socket 100 can then be easily removed from the mounting structure 200 by simply pulling the actuation member 150 along the direction indicated by the vertical arrows shown in FIG. 10.

FIG. 11 shows a final stage of the removing process, in which the relay socket 100 is completely removed from the aperture 202 and the actuation member 150 is in its highest position above the upper part 118.

The relay socket 100 can be easily mounted and/or removed from the mounting structure 200 without the need of any screws or tools by simply actuating the actuation member 150 and without requiring access to both the rear 210 and front 208 sides of the mounting structure 200. Moreover, the relay socket 100 can be quickly and easily installed and/or removed from the mounting structure 200 without removing other sockets and/or relays that might be installed. Further, because the clipping system 130 is formed as an integral part of the main body 110 and/or the clipping legs 155 are formed as an integral part of the actuation member 150, the relay socket 100 has no separable parts and is in an already assembled state when delivered to a customer. Additionally, as the main body 110 and/or the actuation member 150 is formed from plastic materials, the relay socket 100 has a reduced weight in comparison to other conventional relay sockets made of multiple metallic parts.

Although certain features of the above embodiments were described using terms such as "front", "rear", and "upper" and "lower", these terms are used for the purpose of facilitating the description of the respective components of the relay socket 100 and how they are oriented with respect to each other only and should not be construed as limiting the claimed invention or any of its components to an installation or use in a particular spatial orientation. Moreover, although the present invention has been described above with reference to relay sockets 100 for plugging relays, the principles of the present invention can also be advantageously applied to other types of sockets that must be installed on a mounting structure in a quick and secure manner and so as to achieve a dense installation of such devices.

What is claimed is:

1. A relay socket mountable on a mounting structure, comprising:

a main body having an upper part disposed on a first side of the mounting structure and receiving a relay and a lower part extending beyond a fixation edge of the mounting structure to a second side of the mounting structure opposite the first side;

a clipping system disposed on the main body and adapted to lock the main body to the fixation edge; and an actuation member disposed above the upper part of the main body, mechanically coupled to the clipping system, and movable downwards and/or upwards with respect to the main body and the clipping system to change a locking state of the clipping system.

2. The relay socket of claim 1, wherein the clipping system includes a clipping member disposed on the lower part of the main body.

3. The relay socket of claim 2, wherein the clipping member is adapted to flex from a neutral state towards the main body as the lower part passes by the fixation edge and is adapted to resiliently return toward the neutral state when the main body is in a mounting position on the mounting structure.

4. The relay socket of claim 3, wherein the clipping member is attached at a lower end of the lower part of the main body and extends upward along a lateral side of the main body.

5. The relay socket of claim 4, wherein the clipping member has an inward recess at an upper end of the clipping member opposite the lower end of the lower part, the inward recess engaging the fixation edge when the main body is in the mounting position.

6. The relay socket of claim 5, wherein the inward recess of the clipping member has a collapsible feature abutting the fixation edge and capable of being deformed under a pressure exerted by the fixation edge.

7. The relay socket of claim 1, wherein the clipping system has a pair of clipping members disposed on opposite lateral sides of the lower part and fixing the main body to a pair of opposite fixation edges of the mounting structure.

8. The relay socket of claim 1, wherein the clipping system is in at least one of: a neutral state when the actuation member is in an opened configuration, a locked state in which the main body is locked to the fixation edge when the actuation member is in a closed configuration, and an unlocked state that unlocks the main body from the mounting structure when the actuation member is in an unlocked configuration.

9. The relay socket of claim 8, wherein the actuation member includes an interlocking element that projects from a lower side of the actuation member toward the main body and partially extends into a gap between a clipping member of the clipping system and the main body.

10. The relay socket of claim 9, wherein the interlocking element is configured to mechanically interlock with the clipping member depending on a position of the actuation member with respect to the main body.

11. The relay socket of claim 10, wherein the interlocking element has a profile with a recess on a side of the interlocking element facing the clipping member, the recess forming an outward shoulder contacting an end part of the clipping member when the actuation member is in the closed configuration and forcing the clipping member against the fixation edge.

12. The relay socket of claim 11, wherein the interlocking element has an outward-projecting barb at a lower end of the interlocking element, the outward-projecting barb moving along a vertical slot provided on the clipping member when the actuation member is moved with respect to the main body.

13. The relay socket of claim 12, wherein the vertical slot has an upper edge with an inclined profile matching the outward-projecting barb, the outward-projecting barb progressively engaging with the clipping member when the actuation member is moved from the closed configuration to the unlocked configuration.

14. The relay socket of claim 13, wherein the engagement of the outward-projecting barb with the clipping member causes the clipping member to be flexed toward the main body and disengaged from the fixation edge.

15. The relay socket of claim 8, wherein the relay can only be plugged into the relay socket when the actuation member is in the closed configuration.

16. The relay socket of claim 8, further comprising a guiding column extending vertically along through-holes provided on the actuation member and the upper part, the guiding column guiding movement of the actuation member with respect to the upper part, the guiding column including a blind hole receiving a tightening element for fixing the relay and the actuation member to the main body.

17. The relay socket of claim 16, wherein the tightening element is a screw and the guiding column includes a threaded region for tightening the screw, the threaded region is provided at a depth of the blind hole that allows tightening of the screw only when the actuation member is in the closed configuration.

18. The relay socket of claim 17, wherein the guiding column has a lower end that protrudes from the upper part of the main body and forms a guiding pin adapted to fit into a guiding hole disposed on the mounting structure.

19. A relay socket assembly, comprising:

a mounting structure having a fixation edge and a guiding hole; and a relay socket including:

a main body having an upper part disposed on a first side of the mounting structure and receiving a relay and a lower part extending beyond the fixation edge of the mounting structure to a second side of the mounting structure opposite the first side, the guiding hole aligning the relay socket on the mounting structure;

a clipping system disposed on the main body and adapted to lock the main body to the fixation edge; and an actuation member disposed above the upper part of the main body, mechanically coupled to the clipping system, and movable downwards and/or upwards with respect to the main body and the clipping system to change a locking state of the clipping system.

20. A relay socket mountable on a mounting structure, comprising:

a main body having an upper part disposed on a first side of the mounting structure and receiving a relay and a lower part extending beyond a fixation edge of the mounting structure to a second side of the mounting structure opposite the first side; and a clipping system disposed on the main body and adapted to lock the main body to the fixation edge, the clipping system includes a clipping member disposed on the lower part of the main body, the clipping member is adapted to flex from a neutral state towards the main body as the lower part passes by the fixation edge and is adapted to resiliently return toward the neutral state when the main body is in a mounting position on the mounting structure, the clipping member is attached at a lower end of the lower part of the main body and extends upward along a lateral side of the main body, the clipping member has an inward recess at an upper end of the clipping member opposite the lower end of the lower part, the inward recess engaging the fixation edge when the main body is in the mounting position, the inward recess of the clipping member has a collapsible feature abutting the fixation edge and capable of being deformed under a pressure exerted by the fixation edge.

* * * * *